US007501982B2

(12) United States Patent
Charash et al.

(10) Patent No.: US 7,501,982 B2
(45) Date of Patent: Mar. 10, 2009

(54) ANTENNA ALIGNMENT METHOD

(75) Inventors: Dan Charash, Herzlia (IL); Ahikam Aharony, Tel Mond (IL)

(73) Assignee: Provigent Ltd., Nerzlia (IL)

( * ) Notice: Subject to any disclaimer, the term of this patent is extended or adjusted under 35 U.S.C. 154(b) by 227 days.

(21) Appl. No.: 11/581,643

(22) Filed: Oct. 16, 2006

(65) Prior Publication Data

US 2008/0088518 A1 Apr. 17, 2008

(51) Int. Cl.
*H01Q 3/00* (2006.01)

(52) U.S. Cl. ..... 342/359

(58) Field of Classification Search ..... 342/74, 342/79, 81, 359; 343/754, 757; 455/25, 455/277.1

See application file for complete search history.

(56) References Cited

U.S. PATENT DOCUMENTS 3,623,094 A * 11/1971 Paine et al. ..... 342/153
5,376,941 A * 12/1994 Fukazawa et al. ..... 342/359
6,587,699 B2 7/2003 Olsen et al.
6,611,696 B2 8/2003 Chedester et al.
6,661,373 B1 12/2003 Holliday
6,879,295 B2 4/2005 Taylor

* cited by examiner

*Primary Examiner*—Dao L Phan
(74) *Attorney, Agent, or Firm*—Husch Blackwell Sanders LLP Welsh & Katz

(57) ABSTRACT

A method for antenna alignment includes defining a first link budget for wireless communication between first and second communication systems via respective first and second antennas in a normal operational mode in which a main lobe of the first antenna points toward the second antenna. The first antenna is aligned to point to the second antenna responsively to an alignment indication provided by communicating between the first and second communication systems in an alignment operational mode having a second link budget greater than the first link budget.

48 Claims, 3 Drawing Sheets

ANTENNA ALIGNMENT METHOD

FIELD OF THE INVENTION

The present invention relates generally to wireless communication systems, and particularly to methods and systems for performing antenna alignment in wireless communication links.

BACKGROUND OF THE INVENTION

Communication systems, such as point-to-point microwave links, often communicate via directional antennas. In order to establish and maintain communication, the directional antennas should be accurately aligned.

Several methods and systems for performing antenna alignment are known in the art. For example, U.S. Pat. No. 6,661,373, whose disclosure is incorporated herein by reference, describes an antenna alignment meter, which comprises a receiver for detecting a signal with predetermined characteristics and outputting data pertaining to the detection of the signal, and a controller responsive to the data from the receiver for controlling generation of an indicator that signal has been received. The meter can be used for aligning an antenna with a signal source. The meter is arranged to monitor signals received by the antenna and to provide an indication of correct alignment of the antenna with a desired signal source when a signal of a predetermined frequency, polarization, symbol rate and error correction is received.

As another example, U.S. Pat. No. 6,611,696, whose disclosure is incorporated herein by reference, describes an apparatus and method for aligning the antennas of two transceivers of a point-to-point wireless millimeter wave communications link. A narrow band oscillator power source is substituted for the signal transmitting electronics associated with a first antenna and a power detector is substituted for the signal receiving electronics associated with a second antenna. After the antennas are aligned the transceiver electronics are reconnected.

U.S. Pat. No. 6,879,295, whose disclosure is incorporated herein by reference, describes a method in which radio antennas are aligned with each other for the creation of a fixed radio link by temporarily mounting a powered actuator on an antenna forming one end of the link. The actuator is arranged to adjust the alignment of the antenna. The movement of the actuator is controlled over a range of alignments, and variations in the properties of a signal transmitted over the link are measured as the actuator is moved. An optimum actuator position is identified, and the actuator is locked in the optimum position. By using a powered antenna, it is possible to control the alignment of several antennas from a single convenient location. Once the antenna has been secured in the selected position the powered actuator may be recovered for use elsewhere U.S. Pat. No. 6,587,699, whose disclosure is incorporated herein by reference, describes a system and method for aligning the antennas of two transceivers of a point-to-point wireless millimeter wave communications link and keeping them aligned. Each of two communicating antennas is equipped with a telescopic camera connected to a processor programmed to recognize landscape images. The processors are programmed to remember the pattern of the landscape as it appears when the antennas are aligned. Each of the cameras then view the landscape periodically or continuously and if the landscape in view changes by more than a predetermined amount a signal is provided to indicate a misalignment.

Several vendors offer test sets and kits for microwave antenna alignment. For example, Pendulum Instruments, Inc. (Oakland, Calif.), offers an antenna alignment test set called Path Align-R™. Further details regarding this product are available at www.pendulum-instruments.com/eng/htm/xl_2241.php. Another antenna alignment kit is offered by Teletronics, Inc. (Rockville, Md.). Details regarding this product are available at www.teletronics.com/Accessories.html #antennaalignmentkit.

SUMMARY OF THE INVENTION

There is therefore provided, in accordance with an embodiment of the present invention, a method for antenna alignment, including:

defining a first link budget for wireless communication between first and second communication systems via respective first and second antennas in a normal operational mode in which a main lobe of the first antenna points toward the second antenna; and aligning the first antenna to point to the second antenna responsively to an alignment indication provided by communicating between the first and second communication systems in an alignment operational mode having a second link budget greater than the first link budget.

In some embodiments, the method includes communicating in the normal operational mode after aligning the first antenna to point to the second antenna. In another embodiment, one of the first and second communication systems includes a receiver having a first receiver sensitivity when operating in the normal operational mode and a second receiver sensitivity higher than the first receiver sensitivity when operating in the alignment operational mode.

In yet another embodiment, communicating in the normal operational mode includes communicating at a first symbol rate, and communicating in the alignment operational mode includes communicating at a second symbol rate lower than the first symbol rate. Additionally or alternatively, communicating in the normal operational mode includes modulating data using a first symbol constellation, and communicating in the alignment operational mode includes modulating the data using a second symbol constellation having fewer constellation symbols than the first constellation.

Further additionally or alternatively, communicating in the normal operational mode includes synchronizing the first and second communication systems by transmitting and receiving pilot symbols at a first density, and communicating in the alignment operational mode includes transmitting and receiving the pilot symbols at a second density greater than the first density. In still another embodiment, communicating in the normal operational mode includes synchronizing the first and second communication systems by transmitting and receiving first synchronization sequences having a first length, and communicating in the alignment operational mode includes transmitting and receiving second synchronization sequences having a second length greater than the first length.

In some embodiments, the first and second communication systems support two or more modulation schemes having respective noise performance levels, and communicating in the normal and alignment operational modes includes transmitting and receiving the first and second synchronization sequences using a modulation scheme having a highest noise performance level among the two or more modulation schemes.

In a disclosed embodiment, communicating in the normal operational mode includes encoding data using a first forward error correction (FEC) code having a first code rate, and communicating in the alignment operational mode includes encoding the data using a second FEC code having a second code rate smaller than the first code rate. In some embodiments, the second link budget is greater than the first link budget by more than 20 dB. In another embodiment, communicating in the alignment operational mode includes transmitting an unmodulated carrier, and the alignment indication includes a received power of the unmodulated carrier.

In yet another embodiment, communicating in the alignment operational mode includes producing the alignment indication responsively to only known waveforms transmitted between the first and second communication systems. In an embodiment, communicating in the alignment operational mode includes producing the alignment indication by measuring a received power of a signal transmitted between the first and second communication systems.

In another embodiment, communicating in the normal operational mode includes performing symbol-by-symbol demodulation of a signal transmitted between the first and second communication systems, and communicating in the alignment operational mode includes performing batch demodulation of the signal. In yet another embodiment, aligning the first antenna includes adjusting the main lobe of the first antenna to point to the second antenna using the alignment operational mode, and subsequently fine-tuning an alignment within the main lobe of the first antenna using the normal operational mode.

In still another embodiment, aligning the first antenna includes generating the alignment indication by measuring a plurality of values of a signal quality metric at a respective plurality of angular orientations of the first antenna, selecting an optimal orientation corresponding to a best value of the signal quality metric out of the plurality of the angular orientations, and fixing the first antenna to point to the optimal orientation. The signal quality metric may include at least one metric selected from a group consisting of a received signal level (RSL), a signal to noise ratio (SNR), a mean square error (MSE) and a bit error rate (BER).

In an embodiment, measuring the values of the signal quality metric includes outputting the values to a user, and selecting the optimal orientation and fixing the first antenna includes determining the optimal orientation and fixing the first antenna by the user. In another embodiment, fixing the first antenna includes automatically rotating the first antenna to point to the optimal orientation.

In yet another embodiment, communicating in the normal operational mode includes driving a power amplifier (PA) in one of the first and second communication systems at a first back-off from a compression point of the PA, and communicating in the alignment operational mode includes driving the PA at a second back-off smaller than the first back-off.

In some embodiments, the method includes automatically switching to the normal operational mode after aligning the first antenna. Additionally or alternatively, the method may include automatically switching from the normal operational mode to the alignment operational mode when the main lobe of the first antenna does not point to the second antenna.

In an embodiment, the first communication system includes a transmitter and the second communication system includes a receiver. In another embodiment, the first communication system includes a receiver and the second communication system includes a transmitter.

There is additionally provided, in accordance with an embodiment of the present invention, a wireless communication link, including:

first and second communication systems, which respectively include first and second antennas, at least the first antenna having a main lobe, and which are arranged to communicate with one another in a normal operational mode having a first link budget when a main lobe of the first antenna points toward the second antenna;

a user input coupled to at least one of the first and second communication systems, for switching between the normal operational mode and an alignment operational mode having a second link budget greater than the first link budget; and an alignment processor, for generating an indication of an alignment between the first and second antennas responsively to communication between the first and second communication systems in the alignment mode, and to output the indication for use in aligning the antennas so that the main lobe of the first antenna points toward the second antenna.

There is further provided, in accordance with an embodiment of the present invention, a wireless communication link, including:

first and second communication systems, which respectively include first and second antennas, at least the first antenna having a main lobe, and which are arranged to communicate with one another in a normal operational mode having a first link budget when a main lobe of the first antenna points toward the second antenna, and to communicate with one another in an alignment operational mode having a second link budget greater than the first link budget when the main lobe of the first antenna does not point toward the second antenna; and an alignment processor, for generating an indication of an alignment between the first and second antennas responsively to communication between the first and second communication systems in the alignment mode, and to control an alignment of the antennas using the indication.

The present invention will be more fully understood from the following detailed description of the embodiments thereof, taken together with the drawings in which:

DETAILED DESCRIPTION OF EMBODIMENTS

Overview

Figure 1:
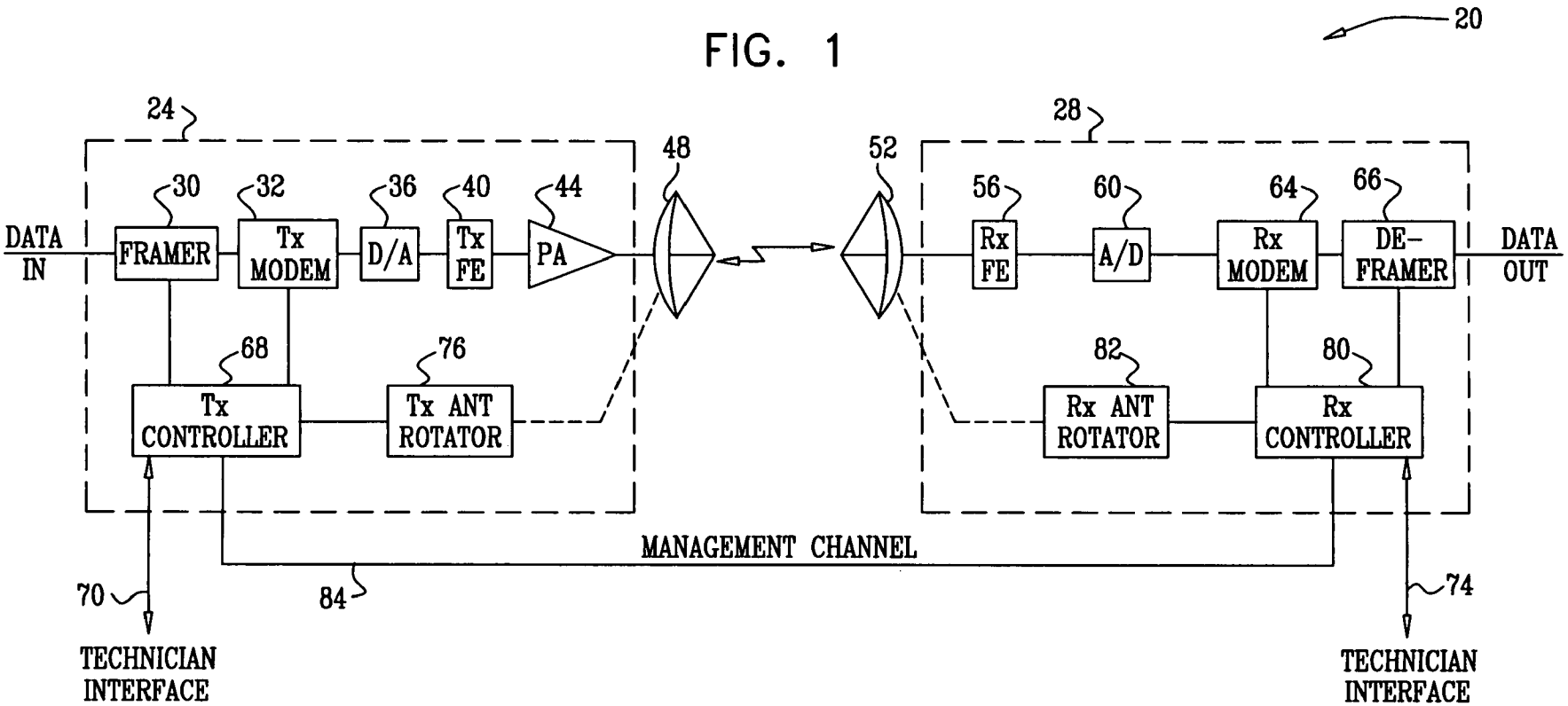
FIG. 1 is a block diagram that schematically illustrates a wireless communication link, in accordance with an embodiment of the present invention.

Wireless communication links often use directional antennas having narrow beam widths. In many cases, the ability to establish and maintain communication over the link is highly sensitive to the alignment of the antennas, i.e., to the accuracy with which the antenna at one end of the link (the transmitter or receiver) points toward the antenna at the other end. Millimeter-wave links having highly directional antennas are particularly sensitive to alignment errors.

The gain difference between the antenna's main lobe and side lobes is significant, often on the order of 20 dB or more. As a result, the signal used for normal communication can usually be detected only via the antenna main lobe and not via its side lobes. When initially setting up a communication link, adjusting the main lobe of the antenna to point in the right direction by attempting to receive the signal used for normal communication is difficult, because of the narrow angular range in which this signal can be detected.

Embodiments of the present invention provide improved methods and systems for aligning directional antennas in wireless communication links. As will be described in detail hereinbelow, the methods and systems described herein enable the transmitter and receiver to communicate via the antenna side lobes during antenna alignment. The transmitter and receiver modems used in the communication link are capable of switching between two operational modes. A normal operational mode is used for normal communication when the antennas are aligned. An alignment operational mode, having an improved link budget with respect to the normal mode, is used during antenna alignment.

A link budget is commonly defined as the sum of all gains and losses applied to the communicated signal along the link. Gains and losses may comprise, for example, analog gains or losses (e.g., an antenna gain or a filter insertion loss) and processing-related gains or losses (e.g., a coding gain of a particular error correction code or the modulation gain of a particular modulation scheme). The term "improved link budget" is used to describe a link budget that enables the transmitter and receiver to communicate in the presence of the higher path attenuation encountered when the antennas are misaligned. Improving the link budget often involves improving the sensitivity of the receiver.

Because of the improved link budget in the alignment mode, the receiver is able to reliably receive and measure the signal transmitted by the transmitter over a relatively wide range of angles, i.e., over a wide angular skew relative to optimal alignment of the antenna and not only via the antenna main lobe. Thus, the received signal can be used as a sensitive and reliable indication for antenna alignment.

In some embodiments, the improved link budget in the antenna alignment operational mode may be achieved, for example, by using a lower symbol rate, a signal constellation having fewer symbols, a higher density of pilot symbols, longer synchronization sequences and/or a lower forward error correction (FEC) code rate, than in the normal operational mode.

In some embodiments, the antenna alignment procedure begins with a relatively coarse alignment in which the main lobe is brought to cover the distant end of the link, and a finer alignment in which the antenna orientation is fine-tuned within the angular range of the main lobe. The methods and systems described herein are particularly suitable for carrying out the coarse alignment, although they can also be used to carry out the fine alignment, as well as the entire procedure.

Unlike some known antenna alignment methods and systems, in the methods and systems described herein the alignment procedure uses the same transmitter and receiver as for normal communication, thus eliminating the need for installing and operating additional or alternative alignment-related equipment. In addition, the antenna alignment can be corrected or refined as needed by switching back to the alignment operational mode during the life cycle of the link, with only minor interruption to the link operation, and not only during initial link installation.

System Description

FIG. 1 is a block diagram that schematically illustrates a wireless communication link 20, in accordance with an embodiment of the present invention. Link 20 comprises a transmitter 24, which accepts input data and transfers it to a receiver 28. The link may comprise a microwave link, a millimeter-wave link or any other suitable wireless link. For example, link 20 may comprise a millimeter-wave link operating in a frequency band higher than 10 GHz, although any other suitable frequency band can be used.

Link 20 may comprise a standalone point-to-point link or may be part of a point-to-multipoint communication system. For the sake of conceptual clarity, the description that follows refers to a unidirectional link. Typically, however, link 20 is part of a bidirectional link between two communication systems, wherein each system comprises a transmitter similar to transmitter 24 and a receiver similar to receiver 28.

The data input to transmitter 24 is formatted and encapsulated in data frames by a framer 30. The data frames are encoded and modulated by a transmit (TX) modem 32. In some embodiments, the TX modem encodes the input data with a forward error correction (FEC) code. Any suitable FEC code can be used. The TX modem modulates the encoded data in accordance with a particular modulation scheme, typically by mapping bits or groups of bits to symbols selected from a particular signal constellation. For example, modem 32 may use quaternary phase shift keying (QPSK), 16-symbol quadrature-amplitude modulation (16-QAM), 64-QAM, or any other suitable modulation scheme. As noted above, the TX modem is capable of switching between a normal operational mode used for communication when the antennas are aligned, and an alignment operational mode used for antenna alignment.

The modulated symbols produced by TX modem 32 are converted to an analog signal using a digital-to-analog (D/A) converter 36. The analog signal is filtered, amplified and up-converted to a suitable radio frequency by a transmitter front-end (TX FE) 40. The radio signal is amplified by a power amplifier (PA) 44 and transmitted to receiver 28 via a transmit (TX) antenna 48.

The signal transmitted by transmitter 24 is received by a receive (RX) antenna 52. A receiver front end (RX FE) 56 down-converts the signal to a suitable intermediate frequency (IF) or to baseband. The RX FE may also perform functions such as low-noise amplification, filtering, gain control, equalization, synchronization and carrier recovery. The signal produced by the RX FE is digitized by an analog-to-digital (A/D) converter 60. The digitized signal is provided to a receive (RX) modem 64. The RX modem demodulates the received symbols and decodes the FEC, so as to reconstruct the data frames. A de-framer 66 extracts the data from the data fames and provides the extracted data as output.

Transmitter 24 comprises a TX controller 68, and receiver 28 comprises an RX controller 80. The TX and RX controllers respectively manage the operation of the transmitter and receiver, and in particular coordinate the switching between the normal communication and antenna alignment operational modes. Controllers 68 and 80 can be jointly viewed as an alignment processor, which carries out the antenna alignment methods described herein. The different alignment functions can be partitioned between controllers 68 and 80 as desired.

In some embodiments, the TX and RX controllers coordinate the mode changes, and otherwise communicate with one another, by exchanging management information over a management channel 84. For example, the TX controller may send information to the RX controller by embedding management information in the data frames produced by framer 30. When link 20 is part of a bidirectional communication link, the RX channel may send information to the TX controller by embedding management information in data frames of the opposite link direction.

In some embodiments, transmitter 24 comprises a TX technician interface 70. Additionally or alternatively, receiver 28 comprises an RX technician interface 74. The TX and RX technician interfaces serve as user input devices, using which a technician can control the operation of link 20. In particular, the technician may switch between the normal and alignment operational modes.

Antenna Alignment Operational Mode

In some embodiments, the TX and/or RX antennas comprise highly-directional antennas. For example, the antenna main lobe may have a 3dB beamwidth narrower than 1° in both azimuth and elevation. Outside the main lobe, the antenna gain drops rapidly. The average side lobe level of the antennas is often on the order of 20-30 dB below the main lobe gain. In some cases, an antenna may have a narrow beamwidth in one dimension and a wider beamwidth in the other dimension.

The description that follows assumes that both the TX and RX antennas comprise directional antennas. The methods and systems described herein can similarly be. used in links in which only one of the antennas, either the TX or the RX antenna, is directional and requires accurate alignment. Configurations having one directional antenna and one wide-angle antenna are commonly used, for example, in point-to-multipoint systems.

Depending on the azimuth and elevation beamwidths of the TX and RX antennas used, the antennas may be aligned in azimuth, elevation or both. In some cases, the antenna orientation is adjusted manually by a technician. Alternatively, the antennas can be rotated and adjusted by suitable antenna rotators. In some embodiments, transmitter 24 comprises a TX antenna rotator 76, which controls the angular orientation of TX antenna 48. Rotator 76 may rotate the antenna in one dimension (e.g., azimuth only) or in both azimuth and elevation. Rotator 76 is controlled by TX controller 68. Additionally or alternatively, receiver 28 may comprise an RX antenna rotator 82, which is controlled by RX controller 80 and adjusts the angular orientation of RX antenna 52.

As can be appreciated from the typical antenna characteristics described above, when the link antennas are misaligned, the signal level received by receiver 28 may drop significantly with respect to the signal level during normal operation (i.e., when the antennas are aligned). When only one antenna is misaligned, the difference in signal level may be on the order of 20-30 dB. When both antennas are misaligned, the signal level may drop by 40-60 dB or more.

This 20-60 dB drop in signal level is usually far below the sensitivity of the receiver when it is configured for communication via aligned antennas. When attempting to align the antennas, a sufficiently strong signal is received only when the antennas point to one another with an accuracy that is better than the width of the main lobe. In the normal operational mode, the receiver is practically blind and cannot measure signal quality metrics at other angular orientations of the antennas. In most cases, particularly when attempting to point two narrow beam antennas toward one another, the alignment procedure using the normal link budget is all but impossible.

In order to enable communication between transmitter 24 and receiver 28 when antennas 48 and 52 are misaligned, the TX and RX modems support an antenna alignment operational mode, which provides a significantly improved link budget with respect to the normal communication mode. The alignment mode enables the RX modem to operate reliably at significantly lower signal to noise ratios (SNR). In other words, the alignment mode increases the bit energy to noise density ratio ($E_b/N_0$) at a given signal level, thus improving the receiver sensitivity. The link budget in the alignment mode is typically 20-25 dB better than the link budget of the normal mode.

In some embodiments, the TX and RX modems may use a reduced symbol rate in the alignment mode, in comparison with the normal mode. For example, if the normal symbol rate is 100 million symbols per second (Msps) and the symbol rate in the alignment mode is 2 Msps, the receiver sensitivity is improved by 17 dB.

Additionally or alternatively, the TX and RX modems may use a signal constellation having fewer symbols in the alignment mode, in comparison with the normal mode. Using a smaller signal constellation increases the Euclidean distances between constellation symbols and improves the receiver sensitivity. For example, if the normal mode uses 64-QAM, which modulates six bits per symbols, using BPSK having one bit per symbol in the alignment mode improves the receiver sensitivity by 15 dB.

Further additionally or alternatively, the TX and RX modems may use a reduced FEC code rate in the alignment mode, in comparison with the normal mode. A lower code rate typically provides a higher coding gain, which improves the receiver sensitivity. Lowering the code rate may enable sensitivity improvements on the order of 5-10 dB with respect to the normal mode.

In some embodiments, the TX modem may transmit pilot symbols to the RX modem in order to perform synchronization. In these embodiments, the density of pilot symbols (i.e., the fraction of time allocated to the transmission of pilot symbols) may be increased in the alignment mode, in order to increase the synchronization robustness under low SNR conditions.

In some embodiments, the TX modem transmits known synchronization symbol sequences, such as preambles, to the RX modem, and the RX modem uses the sequences to synchronize the receiver with the transmitter. In these embodiments, the TX and RX modems may improve the robustness of the synchronization under low SNR conditions by using longer synchronization sequences in the alignment mode. In some cases, the transmitter and receiver may switch between two or more modulation schemes, such as when using adaptive coding and modulation (ACM). In such cases, the synchronization sequences typically use the most robust modulation scheme supported by the link, i.e., the scheme having the best noise performance.

Additional link budget improvements can be achieved, for example, by using a modulation scheme having a low peak to average power ratio (PAR), such as a constant-envelope modulation scheme, in the antenna alignment mode. Such schemes may comprise, for example, binary phase shift keying (BPSK) or QPSK. Using a low PAR signal enables driving PA 44 with a higher average power (i.e., smaller back-off) in comparison with the normal mode, thus improving the link budget.

In some embodiments, the type of signal used in the alignment mode can differ from the signal used in the normal mode. For example, the signal transmitted in the alignment mode may comprise an unmodulated carrier. The receiver in this case typically measures the power of the carrier as an alignment indication. As another example, the signal used for alignment may consist entirely of known waveforms, such as pilot symbols or high processing gain sequences. Demodulating only known waveforms significantly improves the robustness of the receiver, and in particular the robustness of the receiver's synchronization mechanism.

Additionally or alternatively, the receiver may function differently in the normal and alignment modes. For example, the receiver may measure the power of the received signal without performing demodulation in the alignment mode. As another example, the receiver may use different demodulation methods in the normal and alignment modes. For example, the receiver may perform symbol-by-symbol demodulation in the normal mode, and batch demodulation of multiple symbols in the alignment mode.

The antenna alignment mode may comprise any combination of one or more of the link budget improvement measures described above. When link 20 operates in the alignment mode, its data throughput may be decreased. Lowering the symbol rate, reducing the constellation size, reducing the code rate, increasing the density of pilot symbols and/or increasing the preamble length all reduce the net data throughput of the link. This data rate reduction is usually tolerable in the antenna alignment mode, since the transmission is mainly used for signal strength measurements and not for transferring user data. In some embodiments, however, the link may still transfer useful data during antenna alignment. This data may comprise user data provided to transmitter 24, or internal management data.

Figure 2:
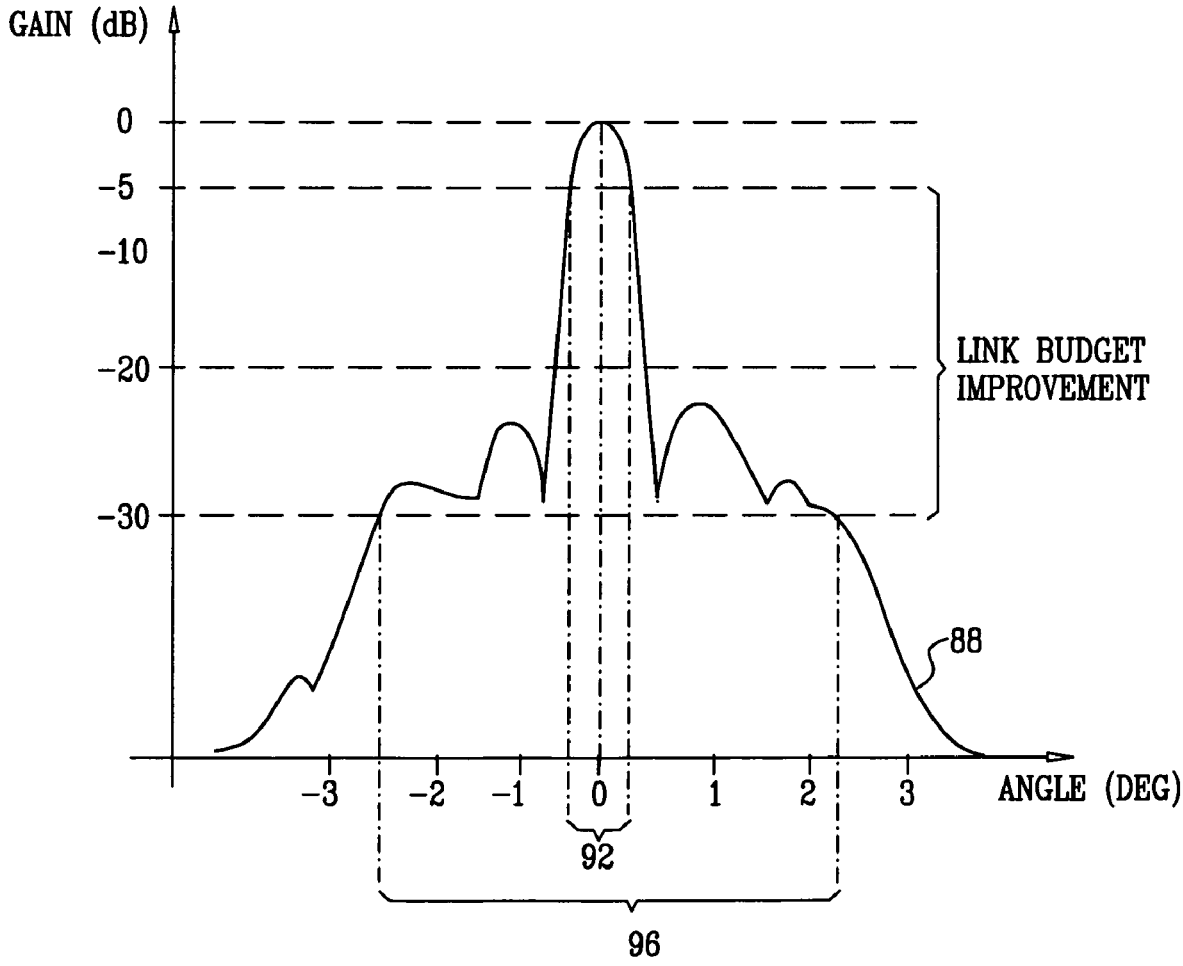
FIG. 2 is a graph showing a radiation pattern of a directional antenna, in accordance with an embodiment of the present invention.

FIG. 2 is a graph showing a radiation pattern of a directional antenna, in accordance with an embodiment of the present invention. The figure is shown as an example for demonstrating the performance improvement provided by the antenna alignment operational mode. A plot 88 shows the antenna gain (in dB, with respect to the main lobe gain) as a function of angle. The plot shows the antenna gain in a single dimension (e.g., azimuth) for the sake of clarity. In the present example, the antenna has a 3 dB beamwidth of approximately 0.5° and a first side lobe level of approximately −22 dB.

In the normal operational mode, it is assumed that the link is designed with an SNR margin of 5 dB. Thus, a sufficiently strong signal is received over a narrow angular range 92 of only approximately 0.7°. Assuming the antenna alignment operational mode improves the link budget by 25 dB, a sufficiently strong signal is received in this mode over a much wider angular range 96 of approximately 4.5°.

The antenna alignment process usually comprises scanning the antenna over a certain angular range and performing signal measurements at different antenna orientations. Receiving a reliably-detectable signal over a wider angular range significantly shortens the duration and improves the quality of the antenna alignment process. For example, the resolution of the scanning process, i.e., the number of angles at which signal measurements are performed, can be significantly reduced.

Figure 3:
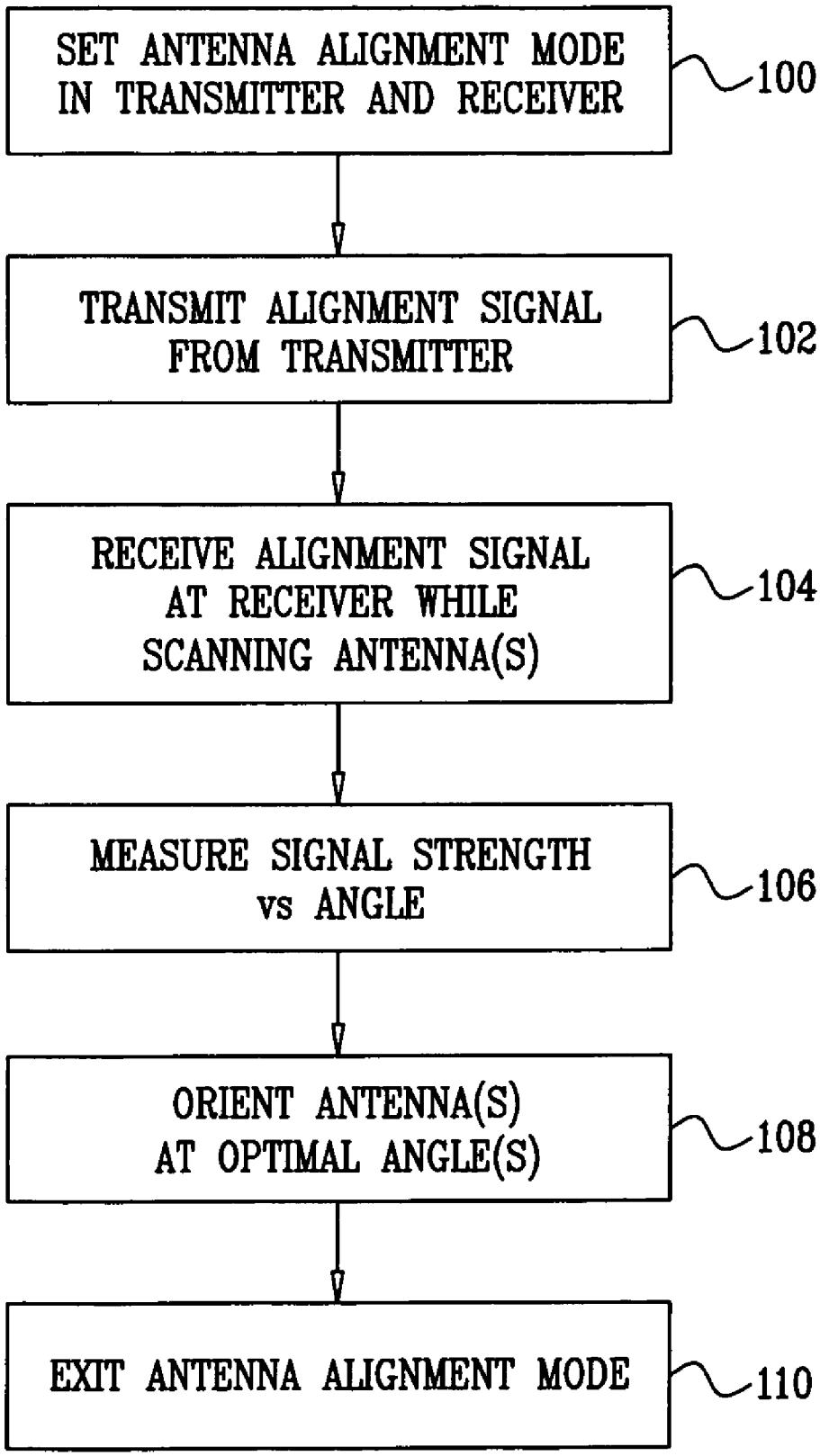
FIG. 3 is a flow chart that schematically illustrates a method for antenna alignment, in accordance with an embodiment of the present invention.

FIG. 3 is a flow chart that schematically illustrates a method for antenna alignment, in accordance with an embodiment of the present invention. The method begins with transmitter 24 and receiver 28 set to the antenna alignment mode, at an alignment setting step 100. In some embodiments, the transmitter and receiver may wake up in the alignment mode when first installed and powered up. Alternatively, the transmitter and receiver may be set to the alignment mode by a technician or other user. Further alternatively, the link may switch automatically from normal operation to the antenna alignment mode when its performance is degraded, or based on any other suitable condition. Both the transmitter and receiver switch their modems to the antenna alignment mode in a coordinated manner.

Transmitter 24 transmits an alignment signal, at a transmission step 102. The alignment signal may convey real data or may comprise dummy data used only for signal measurements. Receiver 28 receives the alignment signal, at a reception step 104. During signal transmission and reception, the antenna being aligned is scanned through a range of angular orientations. As noted above, TX antenna 48, RX antenna 52 or both may be scanned and adjusted. Scanning may be performed manually by a technician or using antenna rotators 76 and/or 82.

RX modem 64 measures the received signal quality during the antenna scanning, at a signal measurement step 106. The signal quality measurements serve as alignment indications, which are used for aligning the antenna. In some embodiments, the RX modem measures the received signal level (RSL) as a function of the scanning angle. Alternatively, other signal quality metrics such as SNR, mean square error (MSE) or bit error rate (BER) can also be used. Because of the improved link budget provided by the antenna alignment mode, the RX modem can reliably receive and measure the received signal over a relatively wide angular range, as demonstrated by FIG. 2 above. Thus, the received signal can be used to produce sensitive and reliable antenna alignment indications.

In some embodiments, the antenna may be scanned through its entire angular range for determining the best-performing angle. Alternatively, the antenna can be scanned only until a peak is found in the signal quality measurements. Determining the best-performing angle can be carried out automatically by RX controller 80, or manually by a technician. For example, the RX controller may output a real-time indication of the received signal quality using technician interface 70 and/or 74, or using a suitable analog or digital display in receiver 28 and/or transmitter 24. The receiver and/or transmitter may also produce an analog voltage that is measured by the technician during the alignment procedure. Generally, any information or indication can be transferred to interface 70 and/or 74 using management channel 84.

The aligned antenna is oriented in the direction that corresponds to the best signal quality, at an antenna setting step 108. Further alternatively, any other suitable scanning method can be used. The transmitter and receiver exit the antenna alignment mode in a coordinated manner, at an exit step 110. Switching from the alignment mode to the normal mode may be performed automatically, such as by automatically determining that the antenna is sufficiently aligned, or manually by a technician.

Although the embodiments described herein mainly address antenna alignment in wireless communication links, the principles of the present invention can also be used for other applications, such as in satellite communication systems.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art. upon reading the foregoing description and which are not disclosed in the prior art.

The invention claimed is:

1. A method for antenna alignment, comprising:

defining a first link budget for wireless communication between first and second communication systems via respective first and second antennas in a normal operational mode in which a main lobe of the first antenna points toward the second antenna; and aligning the first antenna to point to the second antenna responsively to an alignment indication provided by communicating between the first and second communication systems in an alignment operational mode having a second link budget greater than the first link budget.

2. The method according to claim 1, and comprising, after aligning the first antenna to point to the second antenna, communicating in the normal operational mode.

3. The method according to claim 1, wherein one of the first and second communication systems comprises a receiver having a first receiver sensitivity when operating in the normal operational mode and a second receiver sensitivity higher than the first receiver sensitivity when operating in the alignment operational mode.

4. The method according to claim 1, wherein communicating in the normal operational mode comprises communicating at a first symbol rate, and wherein communicating in the alignment operational mode comprises communicating at a second symbol rate lower than the first symbol rate.

5. The method according to claim 1, wherein communicating in the normal operational mode comprises modulating data using a first symbol constellation, and wherein communicating in the alignment operational mode comprises modulating the data using a second symbol constellation having fewer constellation symbols than the first constellation.

6. The method according to claim 1, wherein communicating in the normal operational mode comprises synchronizing the first and second communication systems by transmitting and receiving pilot symbols at a first density, and wherein communicating in the alignment operational mode comprises transmitting and receiving the pilot symbols at a second density greater than the first density.

7. The method according to claim 1, wherein communicating in the normal operational mode comprises synchronizing the first and second communication systems by transmitting and receiving first synchronization sequences having a first length, and wherein communicating in the alignment operational mode comprises transmitting and receiving second synchronization sequences having a second length greater than the first length.

8. The method according to claim 7, wherein the first and second communication systems support two or more modulation schemes having respective noise performance levels, and wherein communicating in the normal and alignment operational modes comprises transmitting and receiving the first and second synchronization sequences using a modulation scheme having a highest noise performance level among the two or more modulation schemes.

9. The method according to claim 1, wherein communicating in the normal operational mode comprises encoding data using a first forward error correction (FEC) code having a first code rate, and wherein communicating in the alignment operational mode comprises encoding the data using a second FEC code having a second code rate smaller than the first code rate.

10. The method according to claim 1, wherein the second link budget is greater than the first link budget by more than 20 dB.

11. The method according to claim 1, wherein communicating in the alignment operational mode comprises transmitting an unmodulated carrier, and wherein the alignment indication comprises a received power of the unmodulated carrier.

12. The method according to claim 1, wherein communicating in the alignment operational mode comprises producing the alignment indication responsively to only known waveforms transmitted between the first and second communication systems.

13. The method according to claim 1, wherein communicating in the alignment operational mode comprises producing the alignment indication by measuring a received power of a signal transmitted between the first and second communication systems.

14. The method according to claim 1, wherein communicating in the normal operational mode comprises performing symbol-by-symbol demodulation of a signal transmitted between the first and second communication systems, and wherein communicating in the alignment operational mode comprises performing batch demodulation of the signal.

15. The method according to claim 1, wherein aligning the first antenna comprises adjusting the main lobe of the first antenna to point to the second antenna using the alignment operational mode, and subsequently fine-tuning an alignment within the main lobe of the first antenna using the normal operational mode.

16. The method according to claim 1, wherein aligning the first antenna comprises generating the alignment indication by measuring a plurality of values of a signal quality metric at a respective plurality of angular orientations of the first antenna, selecting an optimal orientation corresponding to a best value of the signal quality metric out of the plurality of the angular orientations, and fixing the first antenna to point to the optimal orientation.

17. The method according to claim 16, wherein the signal quality metric comprises at least one metric selected from a group consisting of a received signal level (RSL), a signal to noise ratio (SNR), a mean square error (MSE) and a bit error rate (BER).

18. The method according to claim 16, wherein measuring the values of the signal quality metric comprises outputting the values to a user, and wherein selecting the optimal orientation and fixing the first antenna comprises determining the optimal orientation and fixing the first antenna by the user.

19. The method according to claim 16, wherein fixing the first antenna comprises automatically rotating the first antenna to point to the optimal orientation.

20. The method according to claim 1, wherein communicating in the normal operational mode comprises driving a power amplifier (PA) in one of the first and second communication systems at a first back-off from a compression point of the PA, and wherein communicating in the alignment operational mode comprises driving the PA at a second back-off smaller than the first back-off.

21. The method according to claim 1, and comprising automatically switching to the normal operational mode after aligning the first antenna.

22. The method according to claim 1, and comprising automatically switching from the normal operational mode to the alignment operational mode when the main lobe of the first antenna does not point to the second antenna.

23. The method according to claim 1, wherein the first communication system comprises a transmitter and wherein the second communication system comprises a receiver.

24. The method according to claim 1, wherein the first communication system comprises a receiver and wherein the second communication system comprises a transmitter.

25. A wireless communication link, comprising:

first and second communication systems, which respectively comprise first and second antennas, at least the first antenna having a main lobe, and which are arranged to communicate with one another in a normal operational mode having a first link budget when a main lobe of the first antenna points toward the second antenna;

a user input coupled to at least one of the first and second communication systems, for switching between the normal operational mode and an alignment operational mode having a second link budget greater than the first link budget; and an alignment processor, for generating an indication of an alignment between the first and second antennas responsively to communication between the first and second communication systems in the alignment mode, and to output the indication for use in aligning the antennas so that the main lobe of the first antenna points toward the second antenna.

26. The link according to claim 25, wherein one of the first and second communication systems comprises a receiver having a first receiver sensitivity when operating in the normal operational mode and a second receiver sensitivity higher than the first receiver sensitivity when operating in the alignment operational mode.

27. The link according to claim 25, wherein the first and second communication systems are arranged to communicate at a first symbol rate in the normal operational mode, and to communicate at a second symbol rate lower than the first symbol rate in the alignment operational mode.

28. The link according to claim 25, wherein the first and second communication systems are arranged to modulate and demodulate data in the normal operational mode using a first symbol constellation, and to modulate and demodulate the data in the alignment operational mode using a second symbol constellation having fewer constellation symbols than the first constellation.

29. The link according to claim 25, wherein the first and second communication systems are arranged to synchronize with one another in the normal operational mode by transmitting and receiving pilot symbols at a first density, and to synchronize with one another in the alignment operational mode by transmitting the pilot symbols at a second density greater than the first density.

30. The link according to claim 25, wherein the first and second communication systems are arranged to synchronize with one another in the normal operational mode by transmitting and receiving first synchronization sequences having a first length, and to synchronize with one another in the alignment operational mode by transmitting and receiving second synchronization sequences having a second length greater than the first length.

31. The link according to claim 30, wherein the first and second communication systems are arranged to communicate with one another using two or more modulation schemes having respective noise performance levels, and to transmit and receive the first and second synchronization sequences using a modulation scheme having a highest noise performance level among the two or more modulation schemes.

32. The link according to claim 25, wherein the first and second communication systems are arranged to encode data in the normal operational mode using a first forward error correction (FEC) code having a first code rate, and to encode the data in the alignment operational mode using a second forward error correction (FEC) code having a second code rate smaller than the first code rate.

33. The link according to claim 25, wherein the second link budget is greater than the first link budget by more than 20 dB.

34. The link according to claim 25, wherein the first and second communication systems are arranged to transmit an unmodulated carrier in the alignment operational mode, and wherein the indication comprises a received power of the unmodulated carrier.

35. The link according to claim 25, wherein the alignment processor is arranged to produce the indication responsively to only known waveforms transmitted between the first and second communication systems.

36. The link according to claim 25, wherein the alignment processor is arranged to produce the indication by measuring a received power of a signal transmitted between the first and second communication systems.

37. The link according to claim 25, wherein the first and second communication systems are arranged to perform symbol-by-symbol demodulation of a signal transmitted between the first and second communication systems in the normal operational mode, and to perform batch demodulation of the signal in the alignment operational mode.

38. The link according to claim 25, wherein the first and second communication systems are arranged to adjust the main lobe of the first antenna to point to the second antenna using the alignment operational mode, and to subsequently fine-tune the alignment within the main lobe of the first antenna using the normal operational mode.

39. The link according to claim 25, wherein the alignment processor is arranged to generate the indication by measuring a plurality of values of a signal quality metric at a respective plurality of angular orientations of the first antenna.

40. The link according to claim 39, wherein the signal quality metric comprises at least one metric selected from a group consisting of a received signal level (RSL), a signal to noise ratio (SNR), a mean square error (MSE) and a bit error rate (BER).

41. The link according to claim 39, wherein one of the first and second communication systems is arranged to output the values to a user, so as to enable the user to select an optimal orientation corresponding to a best value of the signal quality metric out of the plurality of the angular orientations and to fix the first antenna at the optimal orientation.

42. The link according to claim 39, wherein one of the first and second communication systems is arranged to select an optimal orientation corresponding to a best value of the signal quality metric out of the plurality of the angular orientations, and wherein the first communication system comprises an antenna rotator, which is arranged to orient the first antenna at the selected optimal orientation.

43. The link according to claim 25, wherein one of the first and second communication systems comprises a power amplifier (PA), and wherein the one of the first and second communication systems is arranged to drive the PA at a first back-off from a compression point of the PA when communicating in the normal operational mode, and to drive the PA at a second back-off smaller than the first back-off when communicating in the alignment operational mode.

44. The link according to claim 25, wherein the first communication system comprises a transmitter and wherein the second communication system comprises a receiver.

45. The link according to claim 25, wherein the first communication system comprises a receiver and wherein the second communication system comprises a transmitter.

46. A wireless communication link, comprising:

first and second communication systems, which respectively comprise first and second antennas, at least the first antenna having a main lobe, and which are arranged to communicate with one another in a normal operational mode having a first link budget when a main lobe of the first antenna points toward the second antenna, and to communicate with one another in an alignment operational mode having a second link budget greater than the first link budget when the main lobe of the first antenna does not point toward the second antenna; and an alignment processor, for generating an indication of an alignment between the first and second antennas responsively to communication between the first and second communication systems in the alignment mode, and to control an alignment of the antennas using the indication.

47. The link according to claim 46, wherein the alignment processor is arranged to automatically switch from the alignment operational mode to the normal operational mode when the main lobe of the first antenna points to the second communication system.

48. The link according to claim 46, wherein the alignment processor is arranged to automatically switch from the normal operational mode to the alignment operational mode when the main lobe of the first antenna does not point to the second communication system.

* * * * *